US006166352A

United States Patent [19]

Turton

[11] Patent Number: 6,166,352

[45] Date of Patent: Dec. 26, 2000

[54] ICE SHIELD FOR ROOF EAVES

[76] Inventor: Kenneth Turton, 4770 Pontiac Lake Rd., Waterford, Mich. 48328

[21] Appl. No.: 09/317,346

[22] Filed: May 24, 1999

[51] Int. Cl.[7] ..... H05B 1/00

[52] U.S. Cl. ..... 219/213; 219/541; 219/549

[58] Field of Search ..... 219/200, 201, 219/209, 211–213, 538, 539, 541, 542, 544, 545, 546, 548, 549; 52/518, 520, 522, 543, 519

[56] References Cited

U.S. PATENT DOCUMENTS

| | | | |
|---|---|---|---|
| 3,129,316 | 4/1964 | Glass et al. | 219/213 |
| 4,081,657 | 3/1978 | Standford | 219/213 |
| 4,162,684 | 7/1979 | Loveless, Jr. | 119/73 |
| 4,333,444 | 6/1982 | Sell et al. | 126/417 |
| 4,432,341 | 2/1984 | Howe et al. | 126/417 |
| 4,606,402 | 8/1986 | Dupre | 165/47 |
| 5,786,563 | 7/1998 | Tiburzi | 219/213 |
| 5,813,184 | 9/1998 | McKenna | 52/518 |
| 5,961,849 | 10/1999 | Irgens | 219/549 |

*Primary Examiner*—Tu Ba Hoang

*Attorney, Agent, or Firm*—Gifford, Krass, Groh, Sprinkle, Anderson & Citkowski, P.C.

[57] ABSTRACT

An ice shield for use with an eave of a roof, the roof including a gutter assembly secured in proximity to a downwardly angled and terminating edge of the eave. The shield includes at least one continuously wound roll of a flexible and elongate mat of material which includes a first exposed face and a second reverse side face. The elongate mat is preferably constructed of first and second layers of a durable and rubberized material, capable of convecting heat generated by generally longitudinally extending coils embedded between the layers. The mat is unrolled and positioned atop and along an eave edge location of the roof. An adhesive coating of specified width is applied in longitudinal fashion along the reverse side face and a release tape is applied over the coating to prevent bonding of concentrically wound layers of the roll and prior to a selected length of the roll being unrolled and positioned. The ice shield is preferable installed underneath one or more initial rows of shingles subsequently applied along the roof eave and so that the heat convected from the coils and through the mat is likewise passed through the lower-most shingles so as to melt an ice deposit formed upon the shingles.

12 Claims, 2 Drawing Sheets

FIG-1
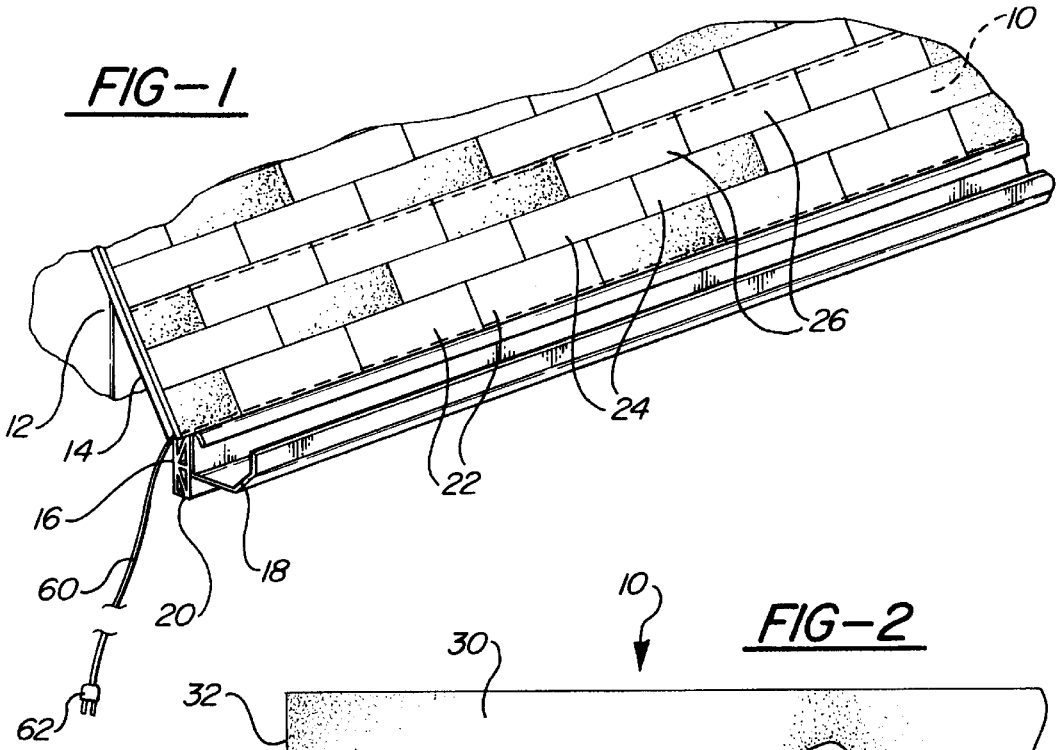
FIG-2
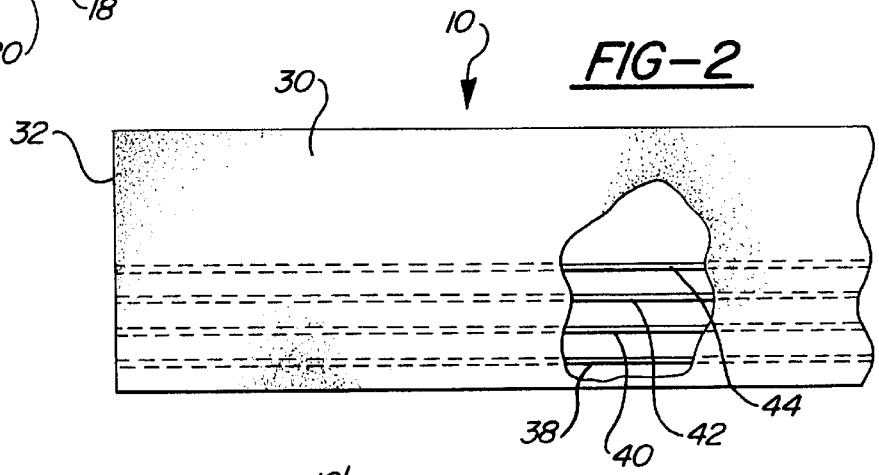
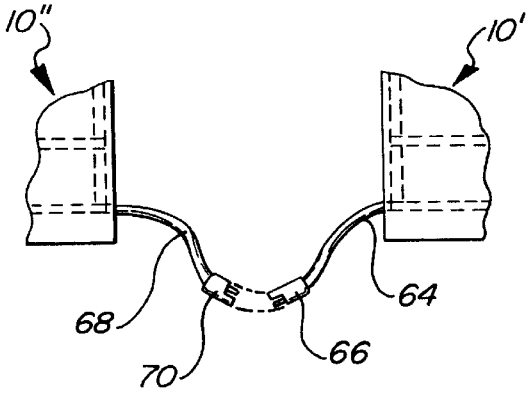
FIG-3
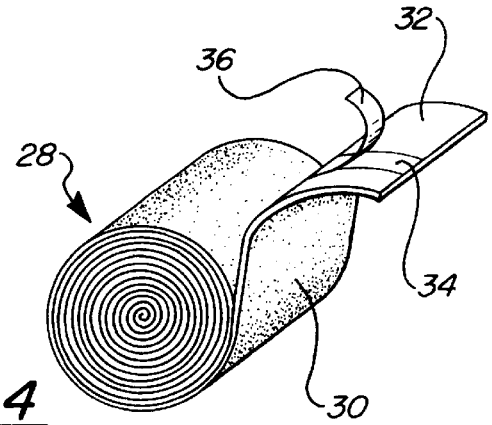
FIG-4

ICE SHIELD FOR ROOF EAVES

BACKGROUND OF THE INVENTION

1. Field of the Invention

The present invention relates generally to ice shielding devices for removing ice dam buildups from roof eave edges and, more particularly, to such a shielding device which employs a resistor coil assembly incorporated within a rubberized mat design for melting ice dams at selected locations along the eave edge.

2. Description of the Prior Art

Examples of ice melting and shielding devices for use in proximity to a roof eave are well known in the art. A first example of such a device is illustrated in the commercial product advertisement entitled Electric Roof & Gutter Cable and which teaches a first length of a heat convective cable which is secured by clips along a roof eave edge and which works in tandem with a further length of likewise heat convective cable laid within an adjoining gutter and downspout. The first and second cords are connected directly to a 120 Volt, weatherproof outlet with appropriate grounding and function to prevent the formation of ice upon pitched roofs, gutters and downspouts.

U.S. Pat. No. 5,786,563, issued to Tiburzi, discloses modular ice and snow removal panels with gutter exclusion valves for removing snow and ice and which includes a series of panels aligned in end-to-end fashion along a roof eave and atop the edge rows of shingles. The panels each include internally arrayed heating elements and an electrically operated valve element proximate a lower edge for the purpose of channeling melted ice and snow either into or over a conventionally secured gutter.

U.S. Pat. No. 5,813,184, issued to McKenna, discloses constructing the roofing shingles with embedded heating elements and interconnecting the shingles electrically by virtue of laterally extending and snap fit tabs which enclose one or more electrical conductors. Numerous solar powered devices are also disclosed in the prior art for melting ice formed upon roof eaves and examples of such include U.S. Pat. No. 4,606,402, issued to Dupre, U.S. Pat. No. 4,432,341, issued to Howe et al., U.S. Pat. No. 4,333,444, issued to Sell et al. and U.S. Pat. No. 4,162,684, issued to Loveless, Jr.

A further novel device for removing ice and snow accumulations from roof eave edges in mechanical rather than heat convective fashion is disclosed by U.S. Pat. No. 5,746,027, issued to Bonerb. The Bonerb device discloses a flexible and inflatable sleeve which is arrayed along the eave edge, atop the initial row of shingles and gutter, and which is responsive to an external supply of pressurized air to inflate and to forcibly shatter the ice accumulated thereon.

SUMMARY OF THE PRESENT INVENTION

The present invention is an ice shield for use with a roof eave which is an improvement over the prior art devices previously described in that it is capable of being applied underneath the initial rows of shingles in unobtrusive fashion, such as during the initial construction phase of the house. The ice shield is provided in a wound roll of flexible and elongate material having a specified width and length with a first exposed face and a second reverse side face. The elongate material may be provided as a single layer of material, but is preferably constructed as first and second layers which are secured together around their outlines.

An adhesive coating of specified width is applied in longitudinal fashion along the reverse side face and a release tape is applied over the adhesive coating to prevent bonding of the concentrically wound layers of the roll and prior to the wound roll being unrolled and positioned along the roof eave edge and the tape being removed.

A plurality of coils extend in a generally longitudinal direction and, according to the preferred embodiment, are embedded between the first and second layers of rubberized and heat convective mat which constitute the ice shield. In one embodiment first, second, third and fourth pluralities of coils are provided in spaced apart and longitudinally extending fashion and are situated along a lower one-half width of the ice shield consistent with the likely position of the ice and snow accumulations which form ice dams. According to further embodiments, the coils are provided as a first pair which extend a parallel spaced distance proximate to the roof eave edge and a second pair which extend in a likewise generally longitudinal direction and in either a sinusoidal wave or zig-zag pattern across the lower one-half width of the shield and which are in electrical communication with the first pair of coils at selected locations.

The present invention also provides for the end-to-end communication of the initial installed flexible mat and a second likewise installed flexible mat by virtue of extension cords which are in electrical communication with the pairs of heat generating coils and which extend from opposing edges of the mats so as to provide current from the initial mat to each succeeding mat as required. The present invention also contemplates that the mat can be provided at a standard width, such as 3', and varying lengths of 36', 50' and 75', with the heat generating coils being located along the lower one-half width (or lower 18") of the mat.

BRIEF DESCRIPTION OF THE DRAWINGS

Reference will now be made to the attached drawings, when read in combination with the following specification, wherein like reference numerals refer to like parts throughout the several views, and in which:

FIG. 1 is an elevational view of the ice shield device according to the present invention and installed atop a roof eave and underneath initial rows of roof shingles;

FIG. 2 is a sectional view in partial cutaway of the ice shield according to a preferred variant and including the first, second, third and fourth pairs of longitudinally extending heat generating coils;

FIG. 3 is a partial view of the section illustrated at 3—3 in FIG. 2 and showing the means for electrically connecting in end-to-end fashion an initial and succeeding ice shield device;

FIG. 4 is an end view showing the ice shield in a wound roll according to the present invention;

DESCRIPTION OF THE PREFERRED EMBODIMENTS

Figure 5:
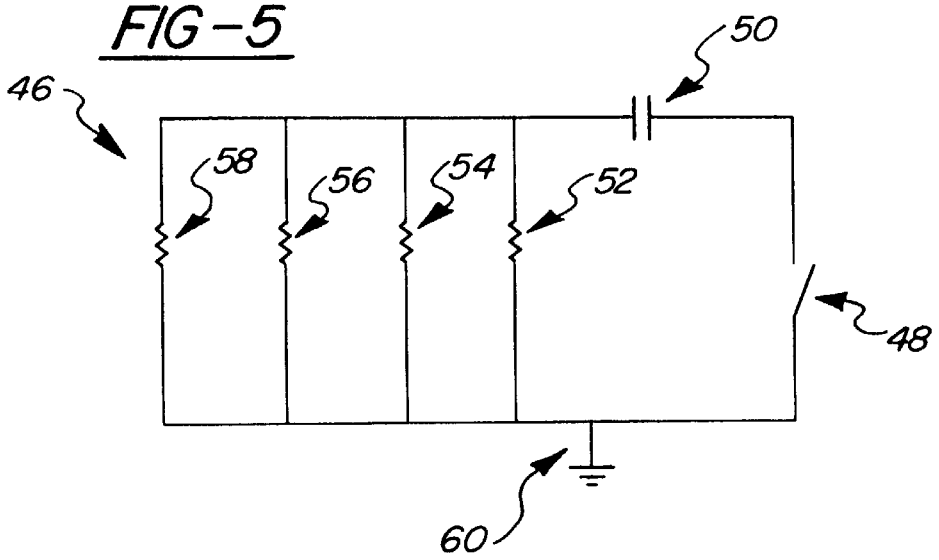
FIG. 5 is a schematic illustrating a basic circuit employed for causing the first, second, third and fourth pairs of coils to generate heat according to the first preferred variant.

Referring now to FIG. 1, an ice shield is illustrated in phantom at 10 in an operative embodiment according to a first preferred embodiment according to the present invention. The shield 10 is utilized in conjunction with a roof assembly 12, the roof 12 including a downwardly and outwardly angled eave 14 concluding in an edge 16 and further including a gutter assembly 18 mounted to a vertically extending header 20 or similar support and extending in proximity to the downwardly extending and terminating edge 16. The purpose of the gutter assembly 18 is to capture melted snow, ice or rain water and to channel the same through interconnected downspouts to a ground location.

As shown in FIG. 1, the ice shield 10 is illustrated in phantom underneath initial rows 22, 24 and 26 of roofing shingles. According to the preferred embodiment, the ice shield device 10 is installed upon the wooden edge of the roof eave 14 and prior to application of the rows of shingles. In this manner, the device 10 remains virtually invisible to the casual observer yet maintains its effectiveness as will be subsequently described. It is also contemplated that the ice shield 10 could be mounted atop existing shingles without departing from the scope of the present invention.

Referring now to FIG. 2, the ice shield 10 is again illustrated and includes an elongate flexible mat material. As is also illustrated in FIG. 4, the shield 10 is provided as a continuous wound roll 28 having a first exposed face 30 and a second reverse side face 32. An adhesive coating 34 is applied along a specified width and in longitudinal fashion along the reverse side face 32 and a release tape 36 is applied over the adhesive coating to prevent bonding of concentrically wound layers of the roll 28 and prior to application to the roof eave 14 as will be subsequently described.

Referring again to FIG. 2, the elongate mat 10 is preferably constructed of a flexible and rubberized material, perhaps black in color, and which is constructed as first and second layers, defined by faces 30 and 32, the layers being secured together around their substantially rectangular outlines by any conventional means known in the art, e.g. stitching, adhesives, and the like. It is also contemplated that the elongate mat type material can be constructed as a single layer consistent with the following description.

Referring again to FIG. 2, pluralities of heat generating coils are shown for use with the ice shield device 10. Specifically, and according to the first preferred variant, first 38, second 40, third 42 and fourth 44 pairs of spaced apart and longitudinally extending coils are arranged along a lower one-half width of the ice shield. Each of the pairs of coils extend in close parallel manner and are constructed of a flexible metallic element, such as copper or the like which provides good conductivity. The coils are embedded within the mat material and this is provided by sandwiching between the first and second layers or by embedding by some other process into a single mat layer of desired thickness. As will also be further explained, it is also desirous that the coils provide significant heat convective characteristics.

According to the preferred embodiment, the ice shield is provided at a consistent width of 3' and varying lengths of 36', 50' and 75' to accommodate varying roofing applications. Accordingly, the pairs of coils 38, 40, 42 and 44 illustrated in FIG. 2 are preferably located within the lower 18" width leading to the roof eave edge 16 upon installation of the ice shield device. So as to accommodate the subsequent placement of the shingling nails and to avoid being pierced, the initial pair of coils 38 are preferably located at a distance of 3" to 5" from the bottom extending edge of the elongate mat which is consistent with the eave edge 16. The remaining second 40, third 42 and fourth 44 pairs of coils are then placed in substantially equidistant parallel running manner such as at 4" to 6" spaced increments. The advantage of this construction is so that it can concentrate all of the heat generating and convective abilities of the flexible coils along the lower one half width of the elongate mat, which is consistent with the location at which ice dams are most likely to occur.

Referring to FIG. 5, a general schematic is illustrated at 46 of the electrical components which are arranged to provide heat convection through the respective pairs of extending coils 38, 40, 42 and 44. Specifically, a voltage input source is indicated at 48 and is provided in conventional means by a power cord connectable to a 120V power supply. A conventional element such as a capacitor is indicated at 50 and prevents against the occurrence of a current surge which could damage the circuitry. The pairs of extending coils 38, 40, 42 and 44 are schematically represented by first 52, second 54, third 56 and fourth 58 resistor elements, respectively, the purpose of the resistor elements being to convert the voltage and current ratio into a resistance through each of the resistor elements which is then dissipated as convected heat. The schematic illustrated is very general in nature with it being understood that numerous different types of parallel or series connections of resistor coil elements can be accomplished and furthermore that different variations of heat convective resistance elements can be employed without departing from the scope of the instant invention.

Referring to FIG. 3, a partial end section of a variation 10' of the ice shield is illustrated and includes a variant for interconnecting the initial ice shield 10' with a further succeeding and identically constructed ice shield 10". Referring again to FIG. 1, the voltage input (shown schematically at 48 in FIG. 5) is typically provided by a first power extension cord 60 extending from a selected edge location of the ice shield and which is typically secured to a weatherproof 120V power outlet. It is also contemplated that other conventional and available power sources could be employed for providing the necessary power to the device.

Referring back to FIG. 3, a further extension cord 64 extends from an edge of the ice shield 10' and terminates in a plug 66. An additional extension cord 68 likewise extends from an opposing edge of the furthering ice shield 10" and also terminates in a plug 70 which is engageable with the plug 66 of cord 64. The pairs of extending coils 38, 40, 42 and 44 are electrically communicable in parallel (as again illustrated by the schematic 46) and permit a single cord extending from each mat to successfully carry current to a succeeding mat. The ability to electrically interconnect one elongate mat 10' with a succeeding mat 10" permit more than one ice shield mat to be secured in end-to-end abutting fashion and to accommodate a selected running length of a roof eave.

Figure 6:
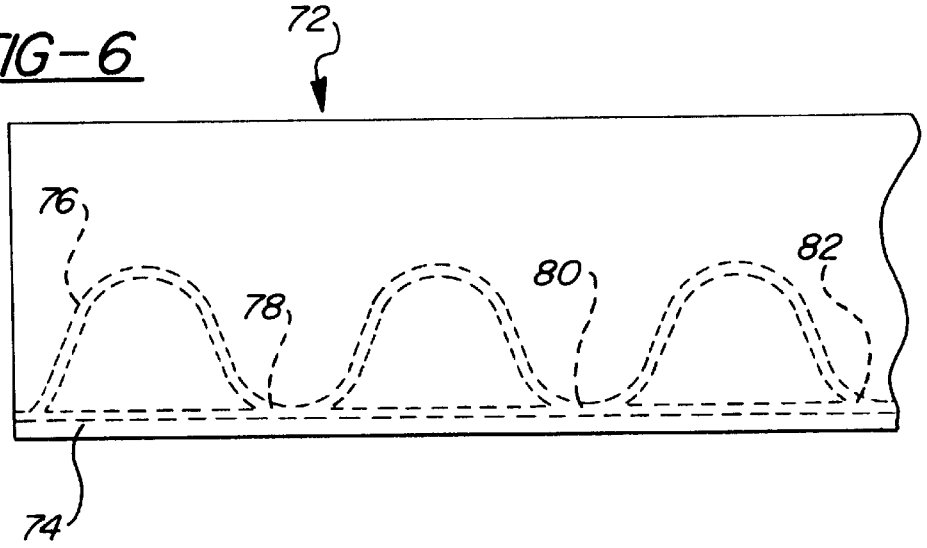
FIG. 6 is a view similar to that shown in FIG. 2 and illustrating a further variant of the ice shield with first pair of longitudinally extending coils and second pair of sinusoidal wave pattern coils according to the present invention.
Figure 7:
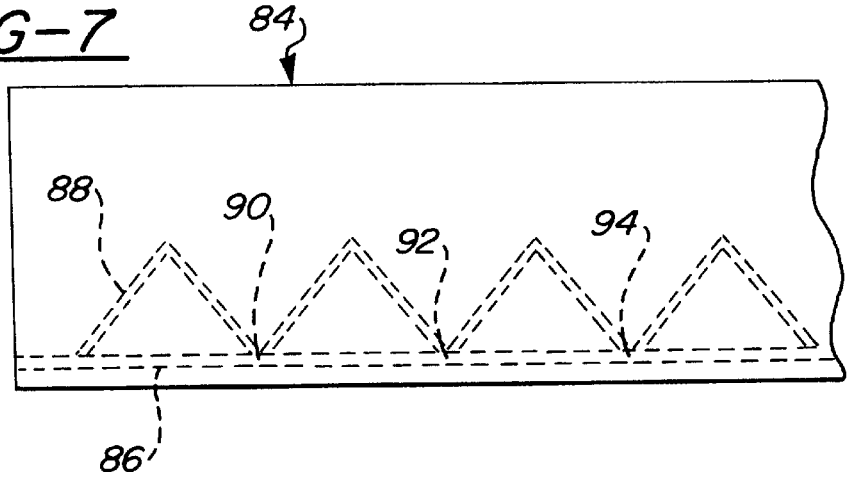
FIG. 7 is a view similar to that shown in FIG. 2 and illustrating a still further variant of the ice shield with first pair of longitudinally extending coils and second pair of zig-zag pattern coils according to the present invention.

Finally, referring to FIGS. 6 and 7, additional preferred embodiments are illustrated for the ice shield and which incorporate different variations of pluralities of elongate running coils. Specifically, referring first to FIG. 6, a first variation 72 is shown and includes a first pair of longitudinally extending coils 74 extending a parallel spaced distance proximate to the roof eave edge. A second pair of coils 76 extends likewise in a generally longitudinal direction and in a sinusoidal wave pattern across a lower one-half width of the ice shield and contacting the first pair of coils 74 at selected locations (see 78, 80, 82, etc.).

Referring to FIG. 7, a further variation 84 is shown and again includes a first pair of longitudinally extending coils

86 extending a parallel spaced distance proximate the roof eave edge and a second pair of coils 88 extends in a generally longitudinal direction and in a zig-zag pattern across the lower one-half width of the ice shield and contacts the first pair of coils 86 at selected locations (see 90, 92, 94, etc.). The purpose of the further ice shield variants 72 and 84 is so that a reduced number of electrical coils can be employed (vis-a-vis the four pairs illustrated in the first preferred embodiment of FIGS. 1–5) while maintaining an approximate degree of effectiveness.

Having described my invention, it will become apparent that it discloses an effective device for removing build-up of ice and snow from the edges of roof eaves. Additional preferred embodiments will also become apparent to those skilled in the art to which it pertains without deviating from the scope of the appended claims.

I claim:

1. An ice shield for use with an eave of a roof, the roof further including a gutter assembly secured in proximity to a downwardly angled and terminating edge of the eave, said ice shield further comprising:

a continuous wound roll of a flexible and elongate mat having a first exposed face and a second reverse side face, an adhesive coating of specified width being applied in longitudinal fashion along said second reverse side face and a release tape being applied over said adhesive coating to prevent bonding of concentrically wound layers of said roll, a selected length of said continuous wound roll being unrolled and positioned along the roof eave edge and said release tape being removed prior to attachment of said length; and a selected plurality of coils extending generally longitudinally within said mat between said first and second faces and converting an externally supplied voltage input source into a resistance heat emitted by said coils and through said flexible and elongate mat so as to melt a deposit of ice formed upon the layers of shingles and contiguous with the roof eave edge.

2. The ice shield as described in claim 1, said mat including a first layer and a second layer, said first and second layers being secured together around their outlines and sandwiching therebetween said plurality of coils.

3. The ice shield as described in claim 1, said ice shield being installed underneath one or more initial rows of shingles subsequently applied along the roof eave.

4. The ice shield as described in claim 1, further comprising first, second, third and fourth pairs of spaced apart and longitudinally extending coils arranged along a lower one-half width of said ice shield.

5. The ice shield as described in claim 4, a first selected pair of coils being longitudinally arrayed at a range of between 3" to 5" from the roof eave edge.

6. The ice shield as described in claim 1, further comprising a first pair of longitudinally extending coils extending a parallel spaced distance proximate to the roof eave edge, a second pair of coils extending likewise in a generally longitudinal direction and in a sinusoidal wave pattern across a lower one-half width of said ice shield and contacting said first pair of coils at selected locations.

7. The ice shield as described in claim 1, further comprising a first pair of longitudinally extending coils extending a parallel spaced distance proximate to the roof eave edge, a second pair of coils extending likewise in a generally longitudinal direction and in a zig-zag pattern across a lower one-half width of said ice shield and contacting said first pair of coils at selected locations.

8. The ice shield as described in claim 1, said voltage input source further comprising a extension cord extending from an edge surface location of said flexible and elongate mat for engagement with a conventional DC outlet.

9. The ice shield as described in claim 8, further comprising a second roll of flexible and elongate mat being unrolled and positioned along the roof eave edge in end-to-end arrangement with said initial wound flexible and elongate mat, each said elongate mat including, at interconnecting ends, a further extension cord which terminates in an adapter for securing together so as to supply said voltage input to said second flexible and elongate mat.

10. The ice shield as described in claim 1, said flexible and elongate mat being constructed of a durable rubberized material with first and second layers and exhibiting a 3' width dimension by 36' length dimension.

11. The ice shield as described in claim 1, said flexible and elongate mat being constructed of a durable rubberized material with first and second layers and exhibiting a 3' width dimension by 50' length dimension.

12. The ice shield as described in claim 1, said flexible and elongate mat being constructed of a durable rubberized material with first and second layers and exhibiting a 3' width dimension by 75' length dimension.

* * * * *